US008777645B2

(12) United States Patent
Cao

(10) Patent No.: US 8,777,645 B2
(45) Date of Patent: Jul. 15, 2014

(54) CARD ACCOMMODATING AND EJECTING DEVICE

(71) Applicants: Fu Tai Hua Industry (Shenzhen) Co., Ltd., Shenzhen (CN); Hon Hai Precision Industry Co., Ltd., New Taipei (TW)

(72) Inventor: Yan-Bang Cao, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 40 days.

(21) Appl. No.: 13/688,247

(22) Filed: Nov. 29, 2012

(65) Prior Publication Data

US 2014/0080336 A1 Mar. 20, 2014

(30) Foreign Application Priority Data

Sep. 20, 2012 (CN) ..... 2012 1 03494907

(51) Int. Cl.
*H01R 13/62* (2006.01)

(52) U.S. Cl.
USPC ..... 439/159

(58) Field of Classification Search
USPC ..... 439/153, 155, 159; 361/754
See application file for complete search history.

(56) References Cited

U.S. PATENT DOCUMENTS

| | | | | |
|---|---|---|---|---|
| 6,974,338 | B1 * | 12/2005 | Hasegawa | 439/159 |
| 7,021,948 | B2 * | 4/2006 | Lin | 439/159 |
| 7,261,574 | B2 * | 8/2007 | DeLuga et al. | 439/152 |
| 2010/0079933 | A1 * | 4/2010 | Liang et al. | 361/679.01 |
| 2013/0063910 | A1 * | 3/2013 | Chao et al. | 361/754 |

* cited by examiner

*Primary Examiner* — Vanessa Girardi
(74) *Attorney, Agent, or Firm* — Novak Druce Connolly Bove + Quigg LLP

(57) ABSTRACT

An accommodating device for holding a card having an engaging portion in place is illustrated. The accommodating device includes a tray, a spring member, a covering member mounted on the tray, a latching mechanism, and a depressible button. The tray includes a bottom plate and two first sidewalls protruding from opposite edges of the bottom plate, which cooperatively defines a receiving channel for insertion of the card. The spring member is positioned on the bottom plate and compressed by the card when the card is received in the receiving channel. The latching mechanism includes a first resilient strip having a first hunched portion, a second resilient strip fixed to the cover, and a latching block fixed to the first and second resilient strips. The latching block is configured for lockingly engage with the engaging portion. The depressible button is arranged above the first hunched portion of the first resilient strip.

7 Claims, 4 Drawing Sheets

CARD ACCOMMODATING AND EJECTING DEVICE

BACKGROUND

1. Technical Field

This invention relates to an accommodating device to hold a card in place.

2. Description of Related Art

Smart cards, such as flash memory cards, enhance the function of an electronic device, e.g. a mobile phone. Thus, a card connector is provided to the electronic device for accommodating the card. The card connectors of related art require considerable thumb pressure to eject the electrical card, a new card connector is needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are described with reference to the accompanying drawings.

Figure 1:
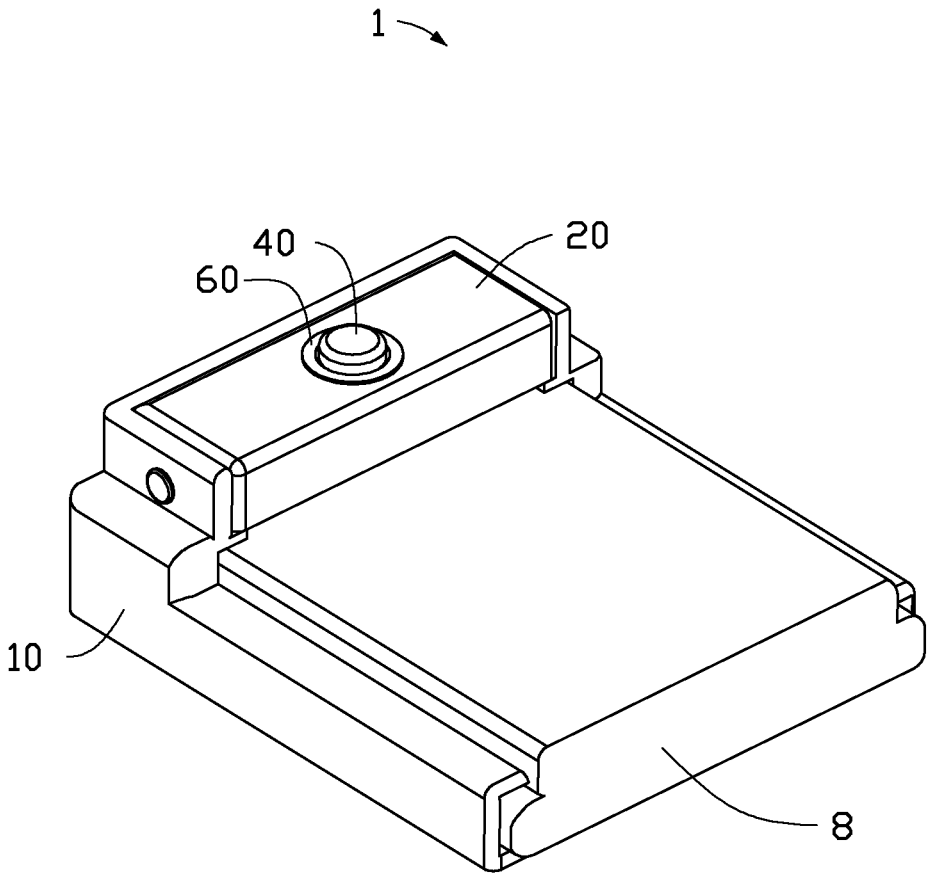
FIG. 1 is an isometric view of an accommodating device for accommodating a card according to an exemplary embodiment.
Figure 2:
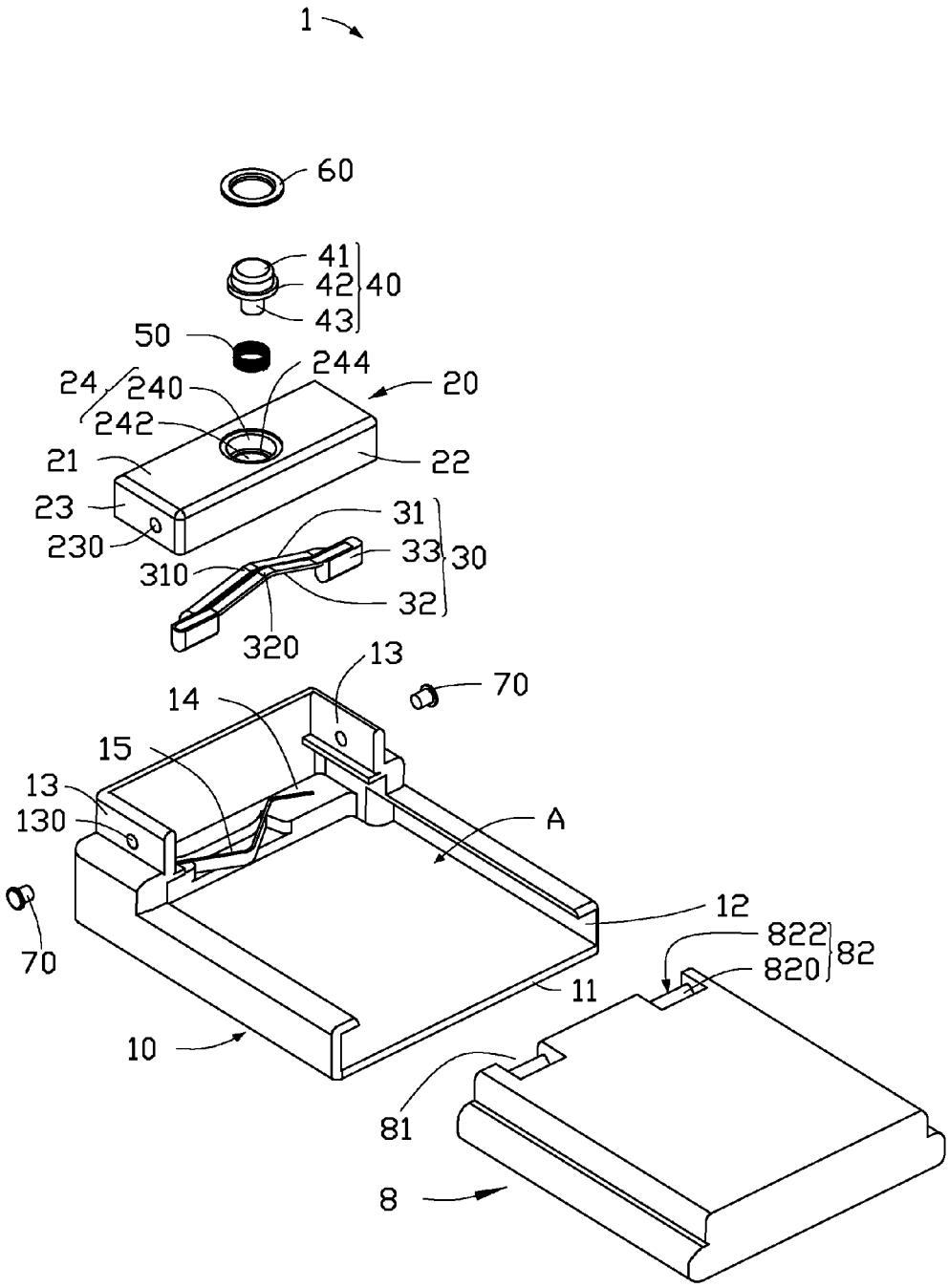
FIG. 2 is an exploded, isometric view of the accommodating device and the card of FIG. 1.

Referring to FIGS. 1 and 2, an accommodating device 1 to hold a card 8 in place is illustrated. In the embodiment, the card 8 is a smart card, and the accommodating device 1 is a card connector. The accommodating device 1 includes a tray 10 fixed to a circuit board of an electronic device (not shown), a covering member 20, a latching mechanism 30, a button 40, a spring coil 50, a locking ring 60, and two fasteners 70. The card 8 defines two notches 81 at one end and includes two engaging portions 82 in the notches 81. The engaging portions 82 each include a first surface 820 and an inclined second surface 822 joined to the first surface 820.

The tray 10 includes a bottom plate 11, two L-shaped first sidewalls 12 respectively protruding from opposite edges of the bottom plate 11, and two second sidewalls 13 respectively protruding inwardly from the top edges of the first sidewalls 12. The bottom plate 11 and the first sidewalls 12 cooperatively define a receiving channel A therebetween for insertion of the card 8 thereinto. The second sidewalls 13 each define a through hole 130. The tray 10 further includes a connecting portion 14 between the two sidewalls 13 and a plate spring 15. The connecting portion 14 is located between the two second sidewalls 13. The spring member 15 is secured to the connecting portion 14. When the card 8 is received in the receiving channel A of the tray 10, the spring member 15 is compressed.

Figure 3:
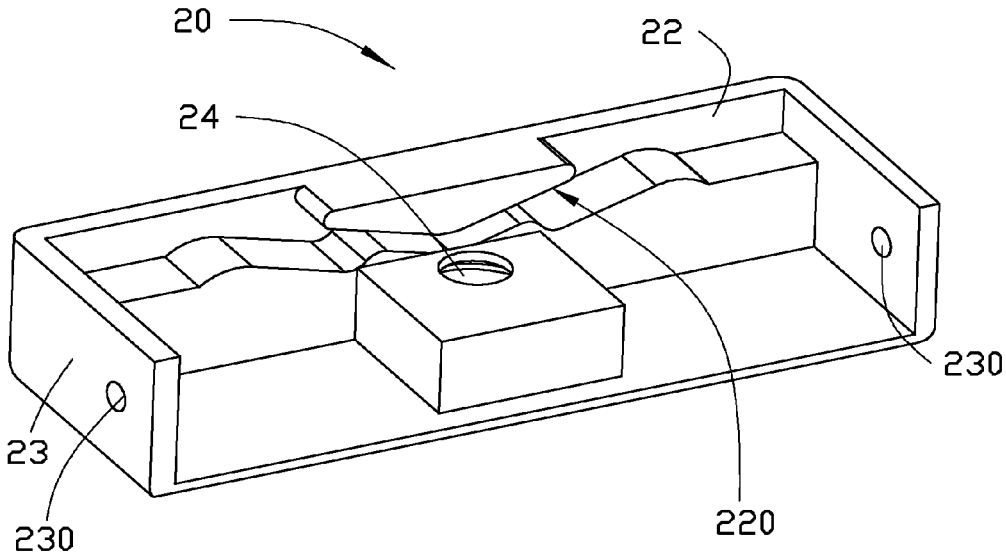
FIG. 3 is an isometric view of a covering member of FIG. 2.

Referring also to FIG. 3, the covering member 20 includes a top surface 21, and a front plate 22 and two side surfaces 23 perpendicularly connected to the base plate 21. The top surface 21 defines a through mounting hole 24. The mounting hole 24 includes a first hole portion 240, a second hole portion 242 communicating with the first hole portion 240, and a shoulder 244 between the first hole portion 240 and the second hole portion 242. The diameter of the first hole portion 240 is greater than that of the second hole portion 242. The front plate 22 defines a fixing slot 220 in an inner side thereof. The side surfaces 23 each define a fastening hole 230 substantially aligned with the through hole 15 of the tray 10. The covering member 20 is positioned between the second sidewalls 13, and the fastener 70 extends through the through hole 130 to be screwed into the fastening hole 230, thereby mounting the covering member 20 on the tray 10.

The latching mechanism 30 includes a first resilient strip 31, a second resilient strip 32 substantially similar to and adjacent to the first resilient strip 31, and two latching blocks 33 fixed to distal ends of the first resilient strip 31 and the second resilient strip 32. The first resilient strip 31 includes a first hunched portion 310 under the mounting hole 21. When the first hunched portion 310 is pressed, the first resilient strip 31 is elastically deformed to lift up the latching blocks 33. The second resilient strip 32 includes a second hunched portion 320 securely retained within the fixing slot 220 of the covering member 20.

The button 40 includes a head portion 41, a flange 42 formed around the head portion 41, and a shank 43 protruding from the lower end of the head portion 41. A diameter of the flange 42 is greater than that of the head portion 41 and that of the shank 43. The shank 43 of the button 40 extends through the second hole portion 212 of the covering member 20 enabling the pressing downwards of the first hunched portion 310 of the latching mechanism 30.

The spring coil 50 is coiled around the shank 43, and sandwiched between the shoulder 214 and the flange 42. The locking ring 60 is sleeved around the head portion 41 and fixed to the top surface 21 of the covering member 20. The locking ring 60 holds the flange 42 captive, to keep the button 40 in the mounting hole 24.

Figure 4:
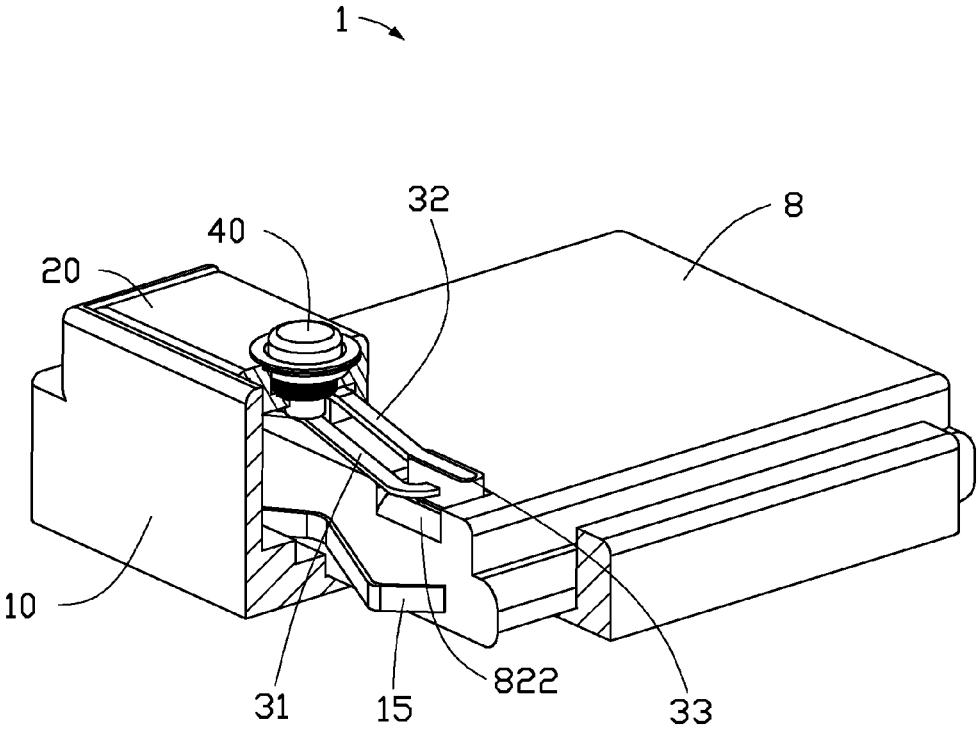
FIG. 4 shows a sectioned view of the accommodating device of FIG. 1.

Referring to FIG. 4, in use, as the card 8 is inserted into the receiving channel A of the tray 10 and the plate spring 15 is compressed, the inclined second surfaces 822 of the engaging portions 82 lift up the latching blocks 33. Impelled by spring pressure, the latching blocks 33 drop into the notch 81 and lockingly engages with the engaging portions 82, thereby locking the card 8 in the receiving channel A. When the button 40 is depressed to urge the first hunched portion 310 of the first resilient strip 31 to move downwards, the first resilient strip 31 is resiliently deformed to lift up the latching blocks 33 away from the engaging portions 82, thereby the card 8 is then ejected by the compressed spring member 15 and moves outwardly from the receiving channel A.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. An accommodating device for holding a card in place, the card comprising at least one engaging portion, the accommodating device comprising:

a tray comprising a bottom plate and two first sidewalls protruding from opposite edges of the bottom plate, the bottom plate and the first sidewalls cooperatively defining a receiving channel for insertion of the card thereinto;

a spring member positioned on the bottom plate, the spring member configured to be compressed by the card when the card is received in the receiving channel;

a covering member mounted on the tray;

a latching mechanism comprising:

a first resilient strip comprising a first hunched portion;

a second resilient strip fixed to the cover;

at least one latching block fixed to distal ends of the first resilient strip and second resilient strip, the at least one latching block configured for lockingly engaging with the at least one engaging portion; and a depressible button arranged above the first hunched portion of the first resilient strip;

wherein, when the card is inserted into the receiving channel and the spring member is compressed, the at least one latching block lockingly engages with the engaging portion, thereby locking the card in the receiving channel;

when the button is depressed to urge the first hunched portion of the first resilient strip to move downwards, the first resilient strip is resiliently deformed to lift up the at least one latching block away from the engaging portion, thereby the card is then ejected by the compressed spring member and moves outwardly from the receiving channel.

2. The accommodating device as described in claim 1, wherein the second sidewalls of the tray each define a through hole, and the covering member comprises two side surfaces each defining a fastening hole, and the base further comprises two fasteners extending through the respective through holes and threadedly engaged in the respective fastening holes for fixing the covering member to the tray.

3. The accommodating device as described in claim 1, wherein the covering member defines a fixing slot, and the second resilient strip comprises a second hunched portion retained in the fixing slot.

4. The accommodating device as described in claim 1, wherein the tray comprises two second sidewalls respectively protruding inwardly from the top edge of the first sidewalls, and the covering member is fixed between the two second sidewalls.

5. The accommodating device as described in claim 4, wherein the tray further comprises a connecting portion between the two second side plates, and the spring member is secured to the connecting portion.

6. The accommodating device as described in claim 1, wherein the covering member defines a mounting hole aligned with the first hunched portion of the first resilient strip, and the button is movably received in the mounting hole.

7. The accommodating device as described in claim 6, wherein the mounting hole comprises a first hole portion, a second hole portion communicating with the first hole portion, and a shoulder between the first hole portion and the second hole portion, the button comprises a head portion, a flange formed around the head portion, and a shank protruding from the lower end of the head portion, the base further comprises a spring coil coiled around the shank and sandwiched between the shoulder and the flange, and a locking ring sleeved around the head portion and fixed to a top surface of the covering member.

* * * * *